US007856354B2

(12) United States Patent
Yonekubo et al.

(10) Patent No.: US 7,856,354 B2
(45) **Date of Patent: *Dec. 21, 2010**

(54) VOICE/MUSIC DETERMINING APPARATUS, VOICE/MUSIC DETERMINATION METHOD, AND VOICE/MUSIC DETERMINATION PROGRAM

(75) Inventors: Hiroshi Yonekubo, Tokyo (JP); Hirokazu Takeuchi, Machida (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/392,911

(22) Filed: Feb. 25, 2009

(65) Prior Publication Data

US 2009/0299750 A1 Dec. 3, 2009

(30) Foreign Application Priority Data

May 30, 2008 (JP) ..... 2008-143647

(51) Int. Cl.
*G10L 11/02* (2006.01)

(52) U.S. Cl. ..... 704/226; 84/616

(58) Field of Classification Search ..... 704/208, 704/211–216, 226; 84/616

See application file for complete search history.

(56) References Cited

U.S. PATENT DOCUMENTS 5,280,562 A 1/1994 Bahl et al.
5,298,674 A * 3/1994 Yun ..... 84/616
5,712,953 A 1/1998 Langs
6,490,554 B2 12/2002 Endo et al.
6,570,991 B1 * 5/2003 Scheirer et al. ..... 381/110
6,990,453 B2 1/2006 Wang et al.
7,130,795 B2 * 10/2006 Gao ..... 704/216
7,191,128 B2 * 3/2007 Sall et al. ..... 704/233
7,606,704 B2 10/2009 Gray et al.
2002/0191798 A1 12/2002 Juric et al.
2003/0055636 A1 3/2003 Katuo et al.
2009/0296961 A1 12/2009 Takeuchi et al.
2009/0299750 A1 12/2009 Yonekubo et al.

FOREIGN PATENT DOCUMENTS

JP 05-232999 9/1993
JP 07-013586 1/1995

(Continued)

OTHER PUBLICATIONS

Eric Scheirer et al.; "Construction and Evaluation of a Robust Multifeature Speech/Music Discriminator"; 1997 IEEE; pp. 1331-1334; Interval Research Corp., Palo Alto, CA.

(Continued)

*Primary Examiner*—Abul Azad
(74) *Attorney, Agent, or Firm*—Blakely, Sokoloff, Taylor & Zafman LLP

(57) ABSTRACT

According to one embodiment, various characteristic parameters for determining whether an input audio signal is a voice signal or a music signal are calculated and the calculated characteristic parameters are compared with a threshold value for voice determination and a threshold value for music determination. A voice characteristic score is provided to a characteristic parameter indicating voice and a music characteristic score is provided to a characteristic parameter indicating music. Then, based on a difference between a sum total of voice characteristic scores and a sum total of music characteristic scores, it is determined whether the input audio signal is a voice signal or a music signal.

8 Claims, 10 Drawing Sheets

FOREIGN PATENT DOCUMENTS

| | | |
|---|---|---|
| JP | 08-185196 | 7/1996 |
| JP | 09-160585 | 6/1997 |
| JP | 10-256857 | 9/1998 |
| JP | 2001-265367 | 9/2001 |
| JP | 2004-125944 | 4/2004 |
| JP | 2005-266098 | 9/2005 |
| JP | 2006-243676 | 9/2006 |
| JP | 2007-004000 | 1/2007 |
| JP | 2007-017620 | 1/2007 |

OTHER PUBLICATIONS

Michael J. Carey et al., "A Comparison of Features for Speech, Music Discrimination"; 1999 IEEE; pp. 149-152; Ensigma Ltd., Turing House, Monmouthshire, UK.

Office Action, U.S. Appl. No. 12/392,921 dated Apr. 1, 2010.

Scheirer, et al., "Construction and Evaluation of a Robust Multifeature Speech/Music Discriminator",0-8186-7919-0/97 IEEE, 1997, pp. 1331-1334.

Carey, et al., "A comparison of Features for Speech, Music Discrimination", 0-7803-5041-3/99, 1999, IEEE, pp. 149-152.

* cited by examiner

VOICE/MUSIC DETERMINING APPARATUS, VOICE/MUSIC DETERMINATION METHOD, AND VOICE/MUSIC DETERMINATION PROGRAM

CROSS-REFERENCE TO RELATED APPLICATIONS

This application is based upon and claims the benefit of priority from prior Japanese Patent Application No. 2008-143647, filed May 30, 2008, the entire contents of which are incorporated herein by reference.

BACKGROUND

1. Field

One embodiment of the invention relates to a voice/music determining apparatus, a voice/music determination method, and a voice/music determination program that quantitatively determine the ratio of a voice signal to a music signal included in an audio (audio frequency) signal to be reproduced.

2. Description of the Related Art

As is well known, in broadcast receivers that receive television broadcasts or information reproducers that reproduce recorded information from an information recording medium containing the recorded information, for example, when an audio signal is reproduced from a received broadcast signal or a signal read from an information recording medium, a sound quality correction process is performed on the audio signal to achieve higher sound quality.

In this case, the content of a sound quality correction process performed on the audio signal varies depending on whether the audio signal is a voice signal such as a person's speaking voice or a music (non-voice) signal such as a musical piece. Specifically, the voice signal needs to be subjected to a sound quality correction process to achieve clarity by emphasizing a center-localized component such as a talk scene or sports commentary, and the music signal needs to be subjected to a sound quality correction process to obtain expanded, emphasized stereo sound.

Hence, the present apparatuses determine whether an obtained audio signal is a voice signal or a music signal and perform an appropriate sound quality correction process on the audio signal, according to the determination result. However, an actual audio signal often includes both a voice signal and a music signal and thus a determination process thereof is difficult. Accordingly, in the present situation it cannot be said that an appropriate sound quality correction process is performed on an audio signal.

Jpn. Pat. Appln. KOKAI Publication No. 7-13586 discloses a configuration in which when the "consonance", "silence", and "power fluctuations" of an input acoustic signal are higher than their respective predetermined threshold values, the signal is determined to be voice, and when the "silence" and the "power fluctuations" of an input acoustic signal are lower than their respective predetermined threshold values, the signal is determined to be music, and otherwise determined to be indeterminate.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, various characteristic parameters for determining whether an input audio signal is a voice signal or a music signal are calculated and the calculated characteristic parameters are compared with a threshold value for voice determination and a threshold value for music determination. A voice characteristic score is provided to a characteristic parameter indicating voice and a music characteristic score is provided to a characteristic parameter indicating music. Then, based on a difference between a sum total of voice characteristic scores and a sum total of music characteristic scores, it is determined whether the input audio signal is a voice signal or a music signal.

Figure 1:
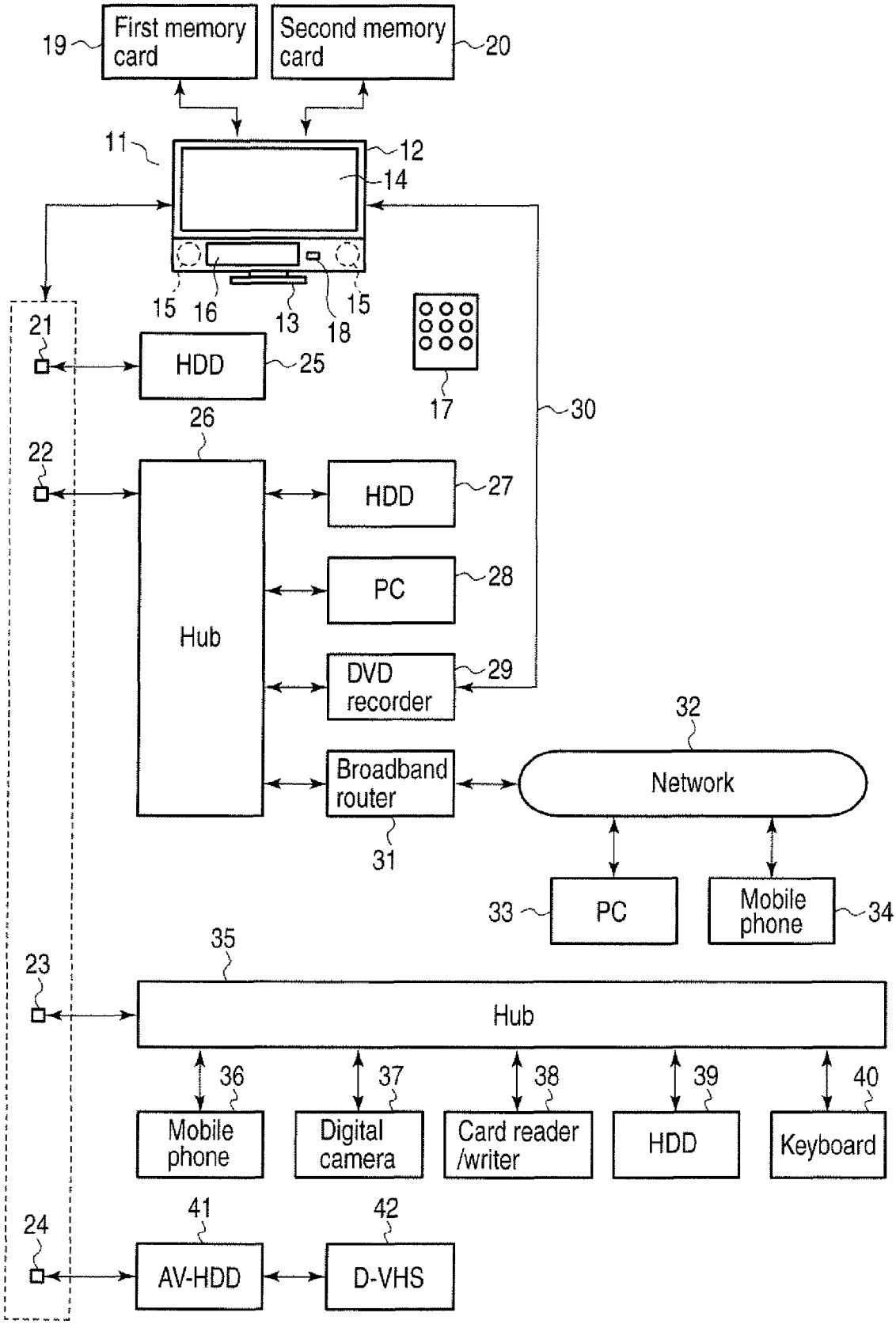
FIG. 1 is a diagram showing one embodiment of the present invention and for schematically describing a digital television broadcast receiving apparatus and an example of a network system with the digital television broadcast receiving apparatus as a main component.

FIG. 1 schematically shows an external appearance of a digital television broadcast receiving apparatus 11 described in the present embodiment and an example of a network system including the digital television broadcast receiving apparatus 11 as a main component.

Specifically, the digital television broadcast receiving apparatus 11 mainly includes a thin cabinet 12 and a support stand 13 that supports the cabinet 12 in a standing position. The cabinet 12 is equipped with a flat-panel type video display 14 composed of, for example, an SED (Surface-conduction Electron-emitter Display) panel or liquid crystal display panel, a pair of speakers 15 and 15, an operation module 16, a light-receiving module 18 that receives operation information to be transmitted from a remote controller 17, and the like.

A first memory card 19 such as an SD (Secure Digital) memory card, an MMC (MultiMedia Card), or a memory stick can be inserted into and removed from the digital television broadcast receiving apparatus 11, whereby recording and reproduction of information such as programs and photos are performed on the first memory card 19.

Furthermore, a second memory card (an IC (Integrated Circuit) card, etc.) 20 in which contract information, for example, is recorded can be inserted into and removed from the digital television broadcast receiving apparatus 11, whereby recording and reproduction of information are performed on the second memory card 20.

In addition, the digital television broadcast receiving apparatus 11 has a first LAN (Local Area Network) terminal 21, a second LAN terminal 22, a USB (Universal Serial Bus) terminal 23, and an IEEE (Institute of Electrical and Electronics Engineers) 1394 terminal 24.

Of the terminals, the first LAN terminal 21 is used as a LAN-compatible HDD (Hard Disk Drive) dedicated port. Specifically, the first LAN terminal 21 is used to perform, by Ethernet (registered trademark), recording and reproduction of information on a LAN-compatible HDD 25 which is a NAS (Network Attached Storage) connected thereto.

By thus providing the first LAN terminal 21, which serves as a LAN-compatible HDD dedicated port, to the digital television broadcast receiving apparatus 11, recording of information on a broadcast program with high-vision image quality can be stably performed on the HDD 25 without being affected by other network environments, network usage, or the like.

The second LAN terminal 22 is used as a general LAN-compatible port using Ethernet (registered trademark). Specifically, the second LAN terminal 22 is used to connect, through a hub 26, to LAN-compatible devices such as an HDD 27, a PC (Personal Computer) 28, and a DVD (Digital Versatile Disk) recorder 29 having an HDD built therein to build a network for home, for example, and perform information transmission with these devices.

In this case, the PC 28 and the DVD recorder 29 each have a function to operate as a content server device in the network for home, and are configured as an UPnP (Universal Plug and Play) compatible device having a service to provide URI (Uniform Resource Identifier) information that is required to access content.

Note that since digital information to be communicated via the second LAN terminal 22 is only control system information, the DVD recorder 29 is provided with a dedicated analog transmission path 30 to transmit analog video and audio information between the DVD recorder 29 and the digital television broadcast receiving apparatus 11.

Furthermore, the second LAN terminal 22 is connected to an external network 32 such as the Internet, through a broadband router 31 connected to the hub 26. The second LAN terminal 22 is also used to perform information transmission with a PC 33, a mobile phone 34, etc., through the network 32.

The USB terminal 23 is used as a general USB-compatible port. For example, the USB terminal 23 is used to connect, through a hub 35, to USB devices such as a mobile phone 36, a digital camera 37, a card reader/writer 38 for a memory card, an HDD 39, and a keyboard 40, and perform information transmission with these USB devices.

Furthermore, the IEEE1394 terminal 24 is used to serial-connect to a plurality of information recording/reproducing devices such as an AV-HDD 41 and a D (digital)-VHS (Video Home System) 42, and selectively perform information transmission with each device.

Figure 2:
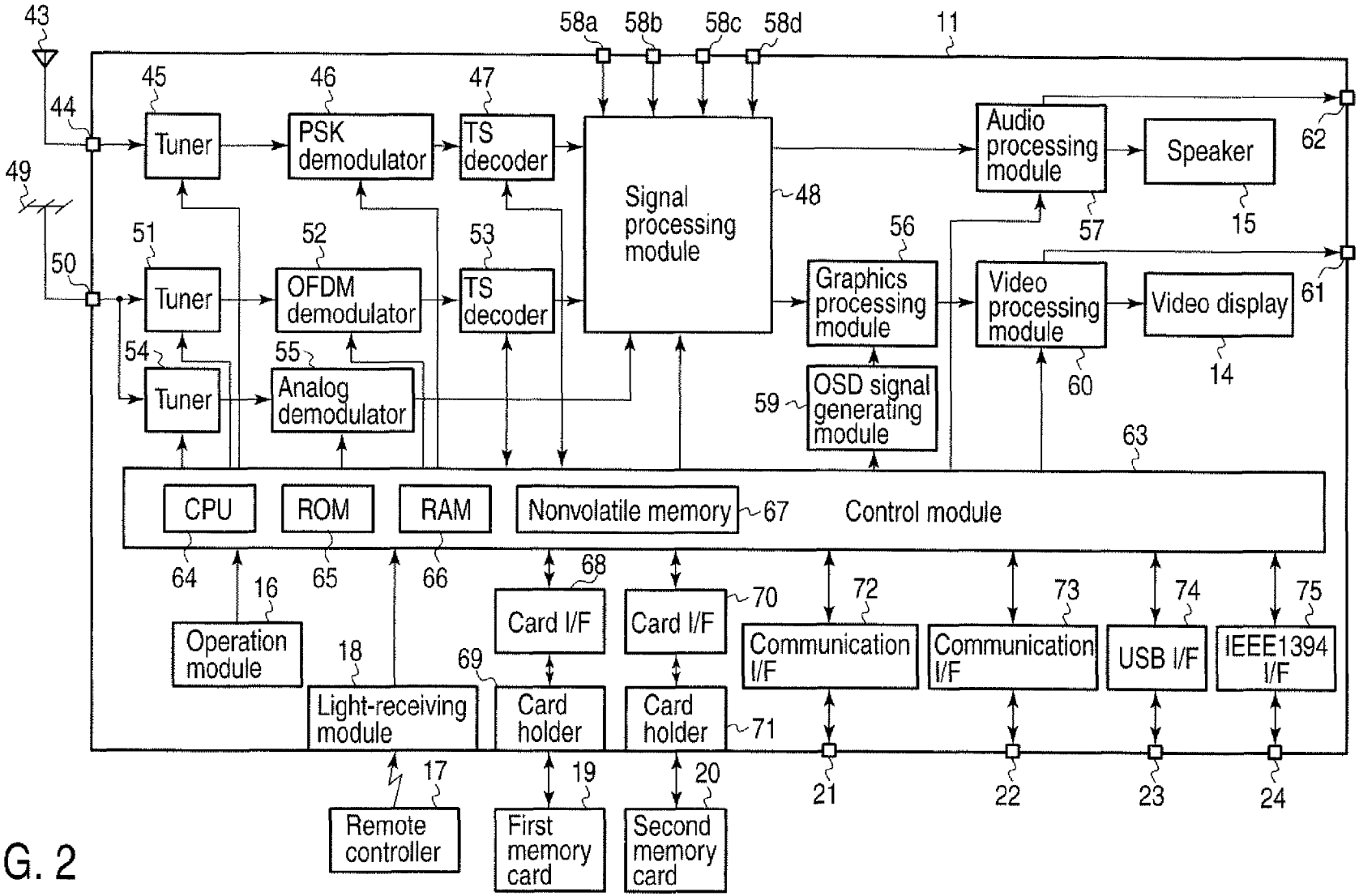
FIG. 2 is a block configuration diagram for describing a main signal processing system of the digital television broadcast receiving apparatus in the embodiment.

FIG. 2 shows a main signal processing system of the digital television broadcast receiving apparatus 11. Specifically, a digital satellite television broadcast signal received by an antenna 43 for BS/CS (Broadcasting Satellite/Communication Satellite) digital broadcast reception is supplied to a tuner 45 for digital satellite broadcasting via an input terminal 44, whereby a broadcast signal of a desired channel is selected.

Then, the broadcast signal selected by the tuner 45 is sequentially supplied to a PSK (Phase Shift Keying) demodulator 46 and a TS (Transport Stream) decoder 47 and thereby demodulated into a digital video signal and a digital audio signal. Thereafter, the signals are output to a signal processing module 48.

A digital terrestrial television broadcast signal received by an antenna 49 for terrestrial broadcast reception is supplied to a tuner 51 for digital terrestrial broadcasting via an input terminal 50, whereby a broadcast signal of a desired channel is selected.

Then, the broadcast signal selected by the tuner 51 is sequentially supplied to, for example, in Japan, an OFDM (Orthogonal Frequency Division Multiplexing) demodulator 52 and a TS decoder 53 and thereby demodulated into a digital video signal and a digital audio signal. Thereafter, the signals are output to the signal processing module 48.

An analog terrestrial television broadcast signal received by the antenna 49 for terrestrial broadcast reception is supplied to a tuner 54 for analog terrestrial broadcasting via the input terminal 50, whereby a broadcast signal of a desired channel is selected. Then, the broadcast signal selected by the tuner 54 is supplied to an analog demodulator 55 and thereby demodulated into an analog video signal and an analog audio signal. Thereafter, the signals are output to the signal processing module 48.

Here, the signal processing module 48 selectively performs predetermined digital signal processing on the digital video signals and the digital audio signals respectively supplied from the TS decoders 47 and 53 and outputs the processed signals to a graphics processing module 56 and an audio processing module 57.

A plurality of (four in the drawing) input terminals 58*a*, 58*b*, 58*c*, and 58*d* are connected to the signal processing module 48. The input terminals 58*a* to 58*d* respectively allow analog video signals and analog audio signals to be input from the outside of the digital television broadcast receiving apparatus 11.

The signal processing module 48 selectively digitizes the analog video signals and the analog audio signals respectively supplied from the analog demodulator 55 and the input terminals 58*a* to 58*d* and performs predetermined digital signal processing on the digitized video and audio signals, and thereafter, outputs the processed signals to the graphics processing module 56 and the audio processing module 57.

The graphics processing module 56 has a function of superimposing an OSD signal to be generated by an OSD (On Screen Display) signal generating module 59 on a digital video signal to be supplied from the signal processing module 48 and outputting the superimposed signal. The graphics processing module 56 can selectively output an output video signal from the signal processing module 48 and an output OSD signal from the OSD signal generating module 59 and can also output the two outputs such that they are combined to respectively configure halves of a screen.

A digital video signal output from the graphics processing module 56 is supplied to a video processing module 60. The video processing module 60 converts the input digital video signal into an analog video signal in a format displayable by the video display 14 and thereafter outputs the analog video signal to the video display 14 to display video, and also allows the analog video signal to be led through an output terminal 61 to an external source.

The audio processing module 57 performs a sound quality correction process, which will be described later, on an input digital audio signal and thereafter converts the processed signal into an analog audio signal in a format reproducible by the speakers 15. Then, the analog audio signal is output to the speakers 15 to perform audio reproduction, and also allows the analog audio signal to be led through an output terminal 62 to an external source.

Here, overall control of all operations of the digital television broadcast receiving apparatus 11 including the above-described various reception operations is performed by a control module 63. The control module 63 contains therein a CPU (Central Processing Unit) 64 and receives operation information from the operation module 16 or operation information sent out from the remote controller 17 and received by the light-receiving module 18 and controls each module to reflect the operation content.

In this case, the control module 63 mainly uses a ROM (Read Only Memory) 65 having stored therein a control program to be executed by the CPU 64, a RAM (Random Access Memory) 66 that provides the CPU 64 with a work area, and a nonvolatile memory 67 in which various setting information, control information, etc., are stored.

The control module 63 is connected, via a card I/F (interface) 68, to a card holder 69 in which the first memory card 19 can be placed. By this, the control module 63 can perform, via the card I/F 68, information transmission with the first memory card 19 placed in the card holder 69.

Furthermore, the control module 63 is connected, via a card I/F (interface) 70, to a card holder 71 in which the second memory card 20 can be placed. By this, the control module 63 can perform, via the card I/F 70, information transmission with the second memory card 20 placed in the card holder 71.

Also, the control module 63 is connected to the first LAN terminal 21 via a communication I/F 72. By this, the control module 63 can perform, via the communication I/F 72, information transmission with the LAN-compatible HDD 25 connected to the first LAN terminal 21. In this case, the control module 63 has a DHCP (Dynamic Host Configuration Protocol) server function and controls the LAN-compatible HDD 25 connected to the first LAN terminal 21 by assigning an IP (Internet Protocol) address to the LAN-compatible HDD 25.

Furthermore, the control module 63 is connected to the second LAN terminal 22 via a communication I/F 73. By this, the control module 63 can perform, via the communication I/F 73, information transmission with each device (see FIG. 1) connected to the second LAN terminal 22.

Also, the control module 63 is connected to the USB terminal 23 via a USB I/F 74. By this, the control module 63 can perform, via the USB I/F 74, information transmission with each device (see FIG. 1) connected to the USB terminal 23.

Furthermore, the control module 63 is connected to the IEEE1394 terminal 24 via an IEEE1394 I/F 75. By this, the control module 63 can perform, via the IEEE1394 I/F 75, information transmission with each device (see FIG. 1) connected to the IEEE1394 terminal 24.

Figure 3:
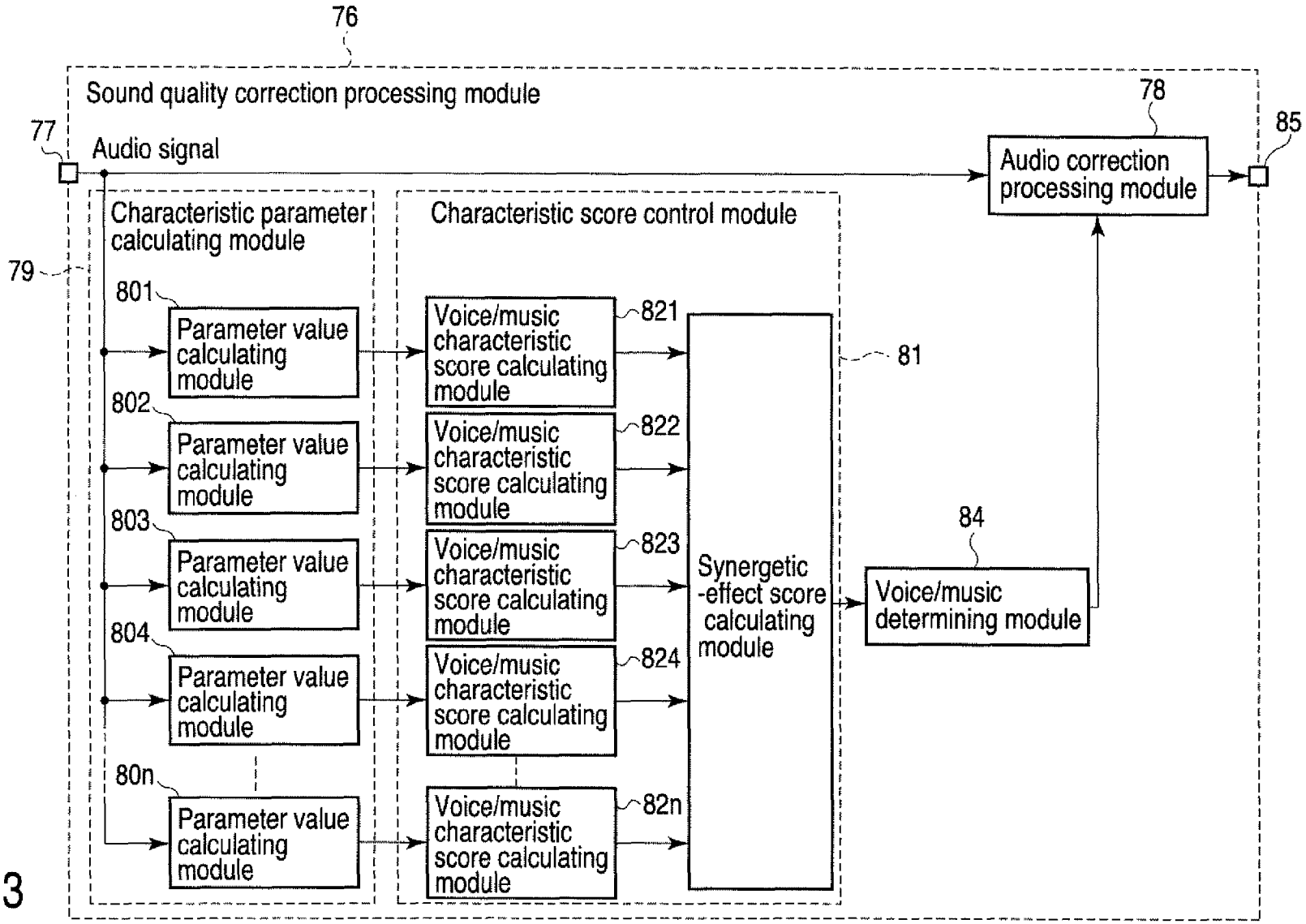
FIG. 3 is a block configuration diagram for describing a sound quality correction processing module included in an audio processing module of the digital television broadcast receiving apparatus in the embodiment.

FIG. 3 shows a sound quality correction processing module 76 included in the audio processing module 57. In the sound quality correction processing module 76, an audio signal composed of, for example, a PCM (Pulse Code Modulation) signal and supplied to an input terminal 77 is supplied to each of an audio correction processing module 78 and a characteristic parameter calculating module 79.

Of these modules, the characteristic parameter calculating module 79 supplies the input audio signal to each of a plurality of (n in the case shown in the drawing) parameter value calculating modules 801, 802, 803, 804, . . . 80*n*. Each of the parameter value calculating modules 801 to 80*n* calculates a characteristic parameter for determining whether the input audio signal is a voice signal or a music signal.

Figure 4:
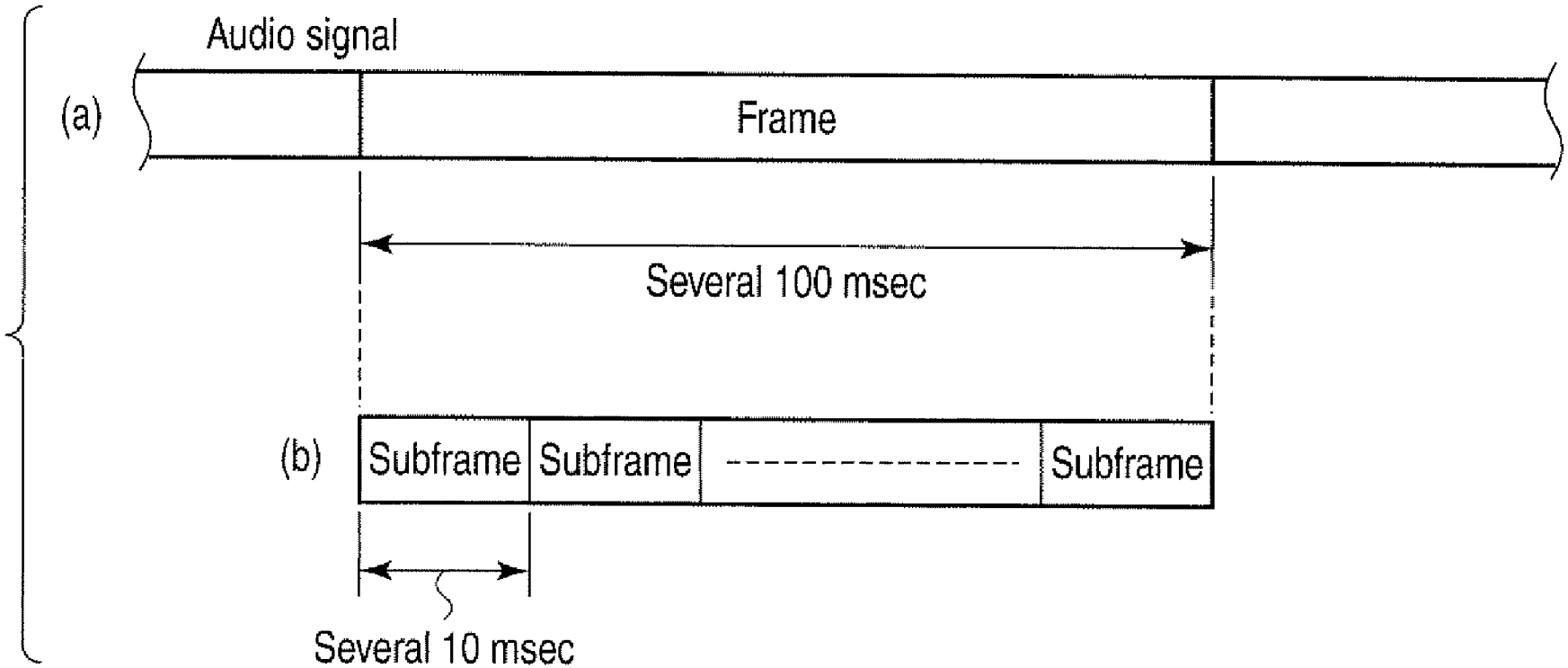
FIG. 4 is a diagram for describing an operation of a characteristic parameter calculating module included in the sound quality correction processing module in the embodiment.

Specifically, each of the parameter value calculating modules 801 to 80*n* cuts the input audio signal into frame units of the order of several 100 msec, as shown in (a) of FIG. 4, and further divides each frame into subframe units of the order of several 10 msec, as shown in (b) of FIG. 4.

Then, each of the parameter value calculating modules 801 to 80*n* calculates, in a subframe unit, determination information for determining whether the audio signal is a voice signal or a music signal and obtains, in a frame unit, statistics such as average and variance of the determination information and thereby generates a characteristic parameter.

For example, the parameter value calculating module 801 calculates, in a subframe unit, a power value which is a sum of squares of signal amplitudes of the input audio signal, as determination information and obtains, in a frame unit, statistics such as average and variance of the determination information and thereby generates a characteristic parameter pw.

The parameter value calculating module 802 calculates, in a subframe unit, a zero-crossing frequency which is the number of times the time waveform of the input audio signal crosses zero in an amplitude direction, as determination information and obtains, in a frame unit, statistics such as average and variance of the determination information and thereby generates a characteristic parameter zc.

Furthermore, the parameter value calculating module 803 calculates, in a subframe unit, a power ratio (LR power ratio) between two-channel stereo left and right (LR) signals in the input audio signal, as determination information and obtains, in a frame unit, statistics such as average and variance of the determination information and thereby generates a characteristic parameter lr.

Figure 5:
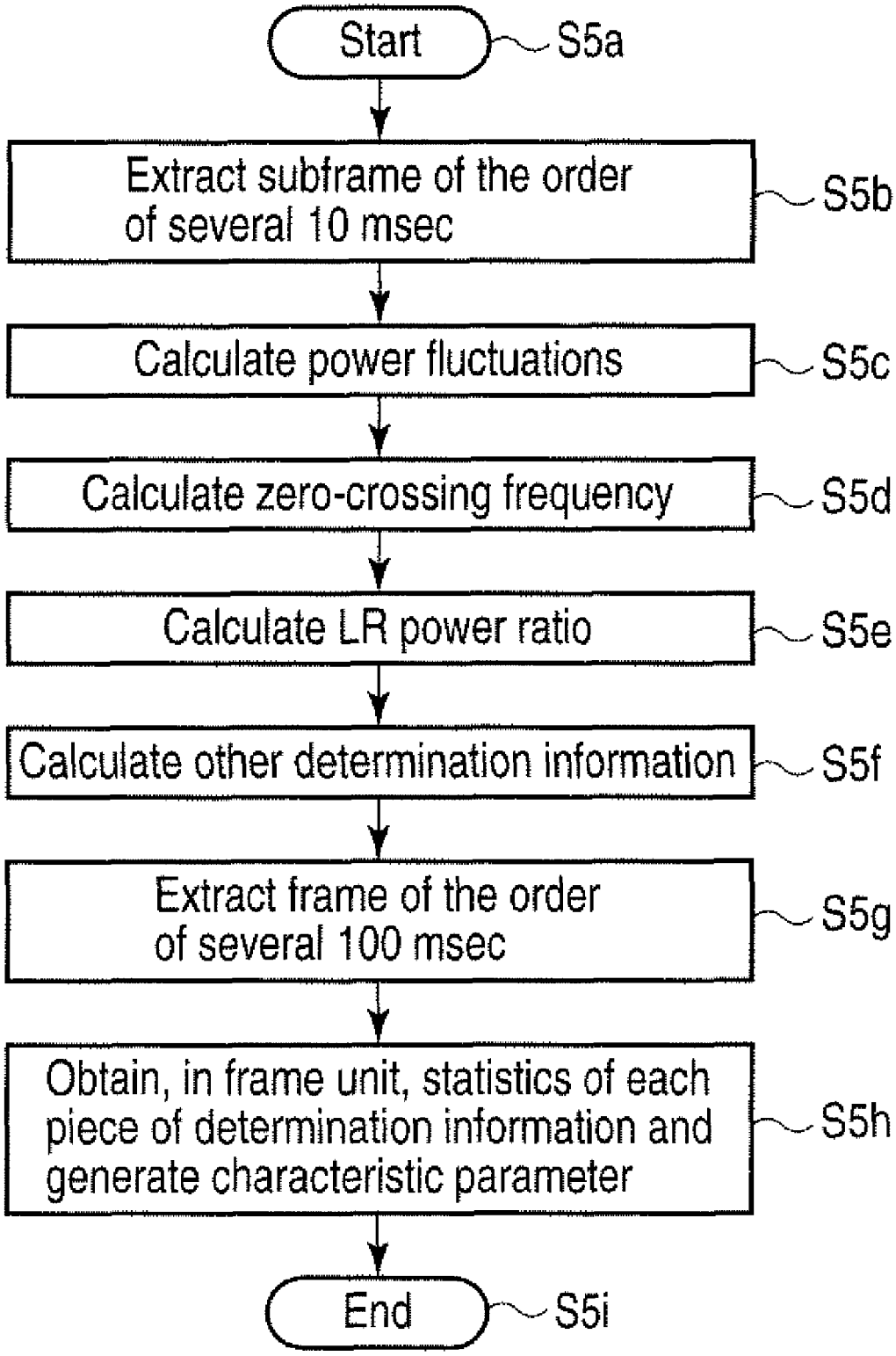
FIG. 5 is a flowchart for describing an operation performed by the characteristic parameter calculating module in the embodiment.

FIG. 5 is a flowchart summarizing processing operations in which the above-described characteristic parameter calculating module 79 generates various characteristic parameters for determining whether an input audio signal is a voice signal or a music signal. Specifically, when a process starts (step S5*a*), at step S5*b*, the characteristic parameter calculating module 79 extracts, by each of the parameter calculating modules 801 to 80*n*, subframes of the order of several 10 msec from an input audio signal.

Then, at step S5*c*, the characteristic parameter calculating module 79 calculates, in a subframe unit, by the parameter value calculating module 801, power from the input audio signal. At step S5*d*, the characteristic parameter calculating module 79 calculates, in a subframe unit, by the parameter value calculating module 802, a zero-crossing frequency from the input audio signal. At step S5*e*, the characteristic parameter calculating module 79 calculates, in a subframe unit, by the parameter value calculating module 803, an LR power ratio from the input audio signal.

Similarly, at step S5*f*, the characteristic parameter calculating module 79 calculates, in a subframe unit, by each of other parameter value calculating modules 804 to 80*n*, other determination information from the input audio signal. Thereafter, at step S5*g*, the characteristic parameter calculating module 79 extracts, by each of the parameter calculating modules 801 to 80*n*, frames of the order of several 100 msec from the input audio signal.

Then, at step S5*h*, the characteristic parameter calculating module 79 obtains, in a frame unit, by each of the parameter calculating modules 801 to 80*n*, statistics such as average and variance of the determination information calculated in a subframe unit and thereby generates a characteristic parameter and then ends the process (step S5*i*).

The characteristic parameters generated in the above-described manner by the respective parameter value calculating modules 801 to 80*n* of the characteristic parameter calculating module 79 are supplied to voice/music characteristic score calculating modules 821, 822, 823, 824 to 82*n* that are provided in a characteristic score control module 81 to respectively correspond to the parameter value calculating modules 801 to 80*n*.

The voice/music characteristic score calculating modules 821 to 82*n* each calculate, based on the characteristic parameters supplied from their corresponding parameter calculating modules 801 to 80*n*, a score S that quantitatively indicates whether the audio signal supplied to the input terminal 77 is close to the characteristics of a voice signal such as a speech or close to the characteristics of a music (musical piece) signal.

For example, the voice/music characteristic score calculating module 821 to which the above-described characteristic parameter pw corresponding to power fluctuations is supplied will be described. As for the power fluctuations, generally, in voice, a speech section and a silence section alternately appear and thus the difference in signal power between subframes is large, and accordingly, in terms of a frame unit, the variance of power values between subframes tends to become large. Note that the power fluctuations as used herein indicate a characteristic amount that takes note of fluctuations in power values calculated in subframes, in a longer frame section, and specifically use a power variance value or the like.

Hence, when the characteristic parameter pw for power fluctuations exceeds a preset upper limit threshold value thUpPw, the voice/music characteristic score calculating module 821 determines that the signal is likely to be a voice signal and thus adds a voice characteristic score Ssp. On the other hand, when the characteristic parameter pw for power fluctuations is smaller than a preset lower limit threshold value thLowPw, the voice/music characteristic score calculating module 821 determines that the signal is likely to be a music signal and thus adds a music characteristic score Smp.

The voice/music characteristic score calculating module 822 to which the above-described characteristic parameter zc corresponding to a zero-crossing frequency is supplied will be described. As for the zero-crossing frequency, in addition to the aforementioned difference between a speech section and a silence section, in a voice signal, the zero-crossing frequency is high for consonants and low for vowels, and thus, in terms of a frame unit, the variance of zero-crossing frequencies between subframes tends to become large.

Hence, when the characteristic parameter zc for a zero-crossing frequency exceeds a preset upper limit threshold value thUpZc, the voice/music characteristic score calculating module 822 determines that the signal is likely to be a voice signal and thus adds a voice characteristic score Ssz. On the other hand, when the characteristic parameter zc for a zero-crossing frequency is smatter than a preset lower limit threshold value thLowZc, the voice/music characteristic score calculating module 822 determines that the signal is likely to be a music signal and thus adds a music characteristic score Smz.

Furthermore, the voice/music characteristic score calculating module 823 to which the above-described characteristic parameter lr corresponding to an LR power ratio is supplied will be described. As for the LR power ratio, in a music signal, performance of musical instruments other than vocals is often localized at points other than the center, and thus, the power ratio between left and right channels tends to become large.

Hence, when the characteristic parameter lr for an LR power ratio exceeds a preset upper limit threshold value thUpLR, the voice/music characteristic score calculating module 823 determines that the signal is likely to be a music signal and thus adds a music characteristic score Smlr. On the other hand, when the characteristic parameter lr for an LR power ratio is smaller than a preset lower limit threshold value thLowLR, the voice/music characteristic score calculating module 823 determines that the signal is likely to be a voice signal and thus adds a voice characteristic score Sslr.

Figure 6:
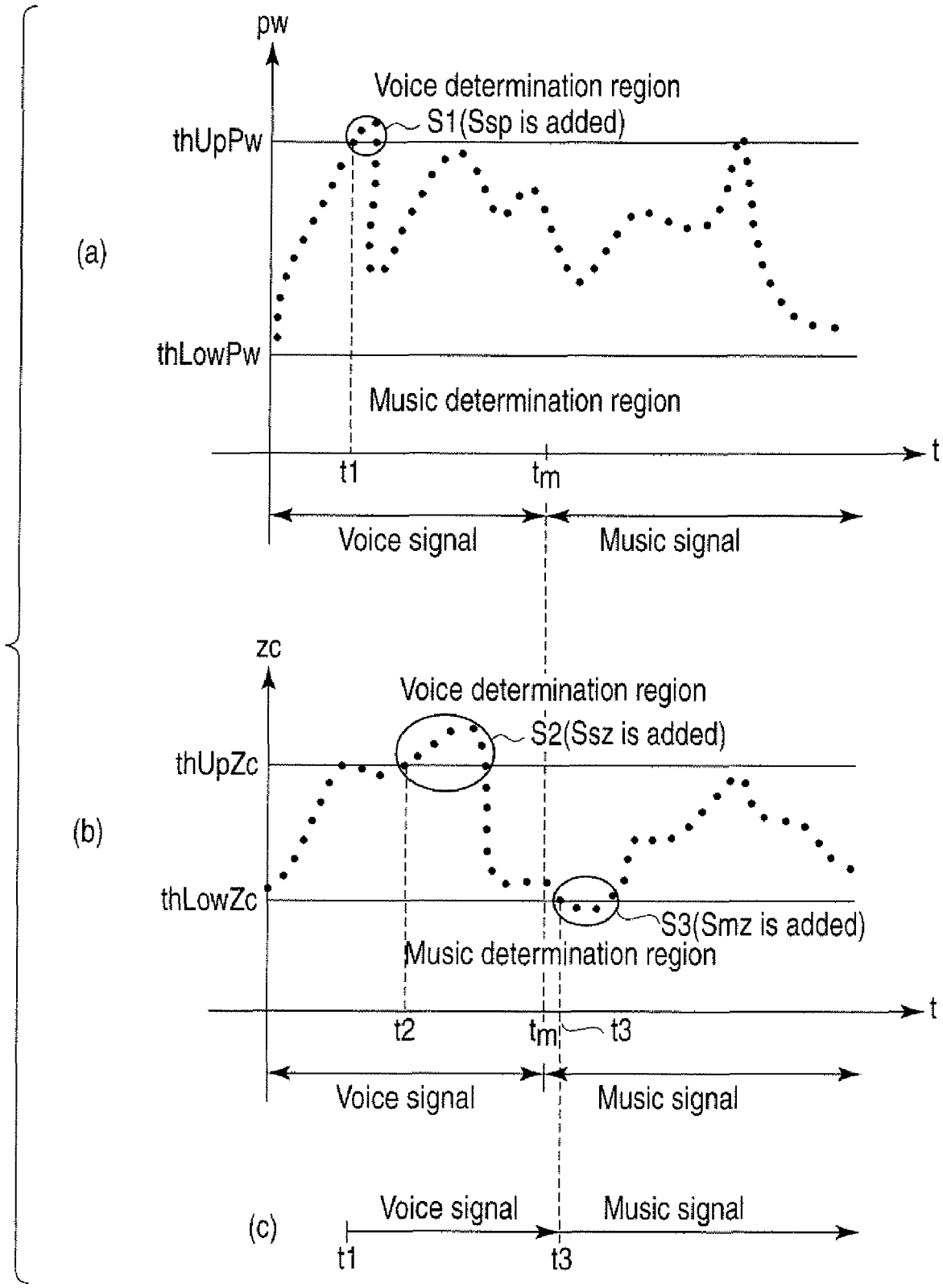
FIG. 6 is a diagram for describing an operation of a characteristic score control module included in the sound quality correction processing module in the embodiment.

Specifically, (a) of FIG. 6 shows the characteristic parameter pw for power fluctuations in the vertical axis relative to time t in the horizontal axis and (b) of FIG. 6 shows the characteristic parameter zc for a zero-crossing frequency in the vertical axis relative to time t in the horizontal axis. Note that in (a) and (b) of FIG. 6, the dots forming a waveform each represent a characteristic parameter value at a certain subframe time point. It is assumed that in practice a section prior to time tm has a voice signal and a section after the time tm has a music signal.

In a region S1 where at time t1 the characteristic parameter pw for power fluctuations exceeds the upper limit threshold value thUpPw and after time t1 the characteristic parameter pw exceeds the upper limit threshold value thUpPw, a voice characteristic score Ssp is added. Similarly, in a region S2 where at time t2 the characteristic parameter zc for a zero-crossing frequency exceeds the upper limit threshold value thUpZc and after time t2 the characteristic parameter zc exceeds the upper limit threshold value thUpZc, a voice characteristic score Ssz is added.

In such a case, if there are no scores by other characteristic parameters in either of the regions, i.e., the region S1 where the characteristic parameter pw exceeds the upper limit threshold value thUpPw and the region S2 where the characteristic parameter zc exceeds the upper limit threshold value thUpZc, then the voice characteristic score>the music characteristic score and thus the signal is determined to be a voice signal.

For those characteristic parameters pw and zc that are present between the upper limit threshold values thUpPw and thUpZc and the lower limit threshold values thLowPw and thLowZc after time t1, they are neutral and thus are not subjected to a determination. As such, when a determination is indeterminate, the signal is considered to be the same as that determined immediately therebefore, and thus, a score determination does not need to be forcedly performed on neutral characteristic parameters. Hence, after time t1, as shown in (c) of FIG. 6, the signal is determined to be a voice signal.

Thereafter, in a region S3 where at time t3 the characteristic parameter zc for a zero-crossing frequency is smaller than the lower limit threshold value thLowZc and after time t3 the characteristic parameter zc is smaller than the lower limit threshold value thLowZc, a music characteristic score Smz is added. Hence, if there are no scores by other characteristic parameters, then the voice characteristic score<the music characteristic score and thus after time t3, as shown in (c) of FIG. 6, the signal is determined to be a music signal.

Figure 7:
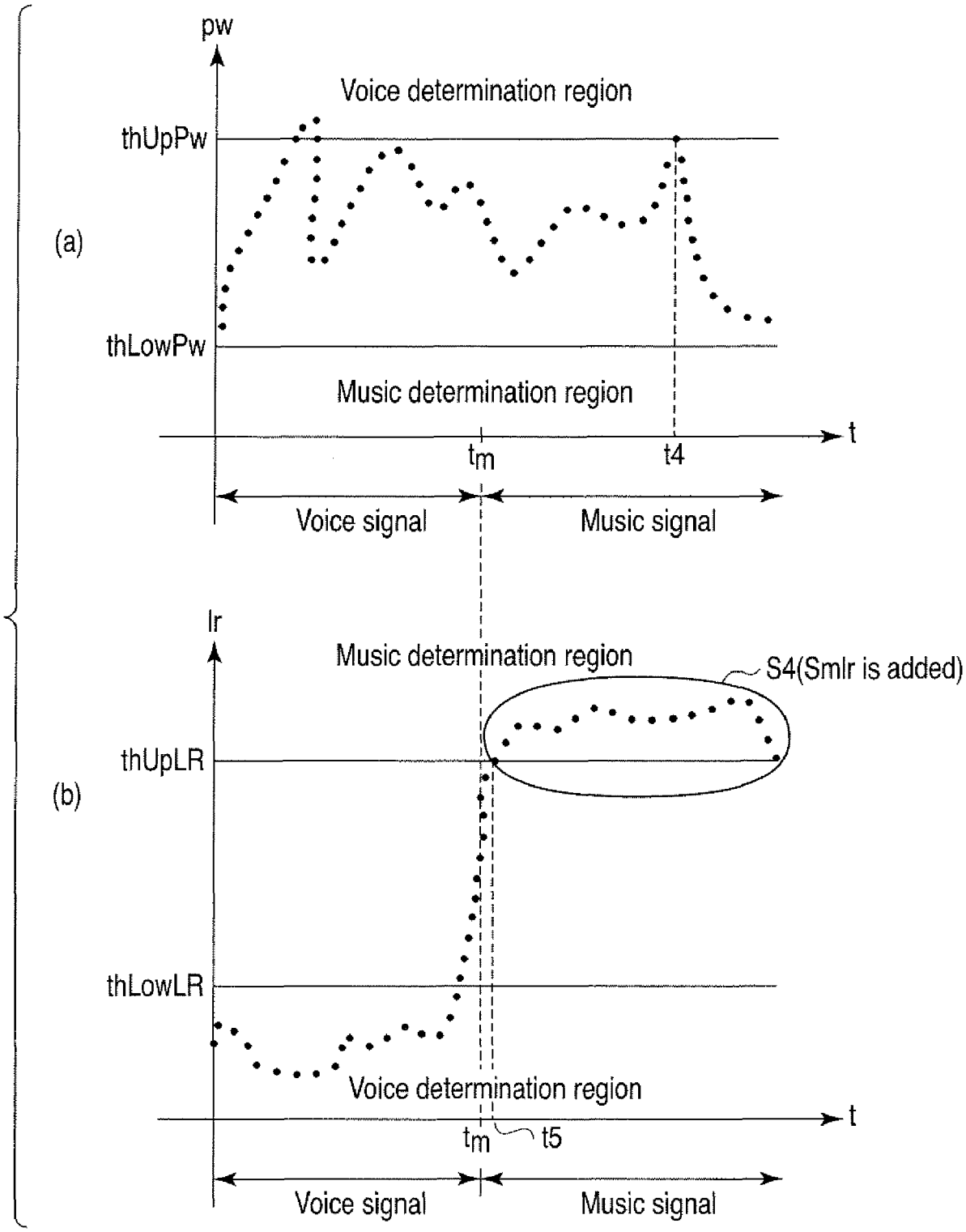
FIG. 7 is a diagram for describing another operation of the characteristic score control module included in the sound quality correction processing module in the embodiment.

The above is the basic operation for determination by scores. Here, with reference to FIG. 7, stability of determination by multiple parameters will be described. (a) of FIG. 7 shows the characteristic parameter pw for power fluctuations in the vertical axis relative to time t in the horizontal axis and (b) of FIG. 7 shows the characteristic parameter lr for an LR power ratio in the vertical axis relative to time t in the horizontal axis. Note that in (a) and (b) of FIG. 7, the dots forming a waveform each represent a characteristic parameter value at a certain subframe time point. It is assumed that in practice a section prior to time tm has a voice signal and a section after the time tm has a music signal.

Specifically, when taking note of only a single characteristic parameter pw, even if the upper limit threshold value thUpPw and the lower limit threshold value thLowPw are set in a range close to a peak value of the characteristic parameter pw, erroneous determination occurs. For example, at time t4, although the actual audio signal is a music signal, the characteristic parameter pw for power fluctuations is locally as large as to exceed the upper limit threshold value thUpPw. In this case, since a voice characteristic score Ssp is added, when taking note of only the power fluctuations, the signal is determined to be a voice signal.

Also, at time t4, if the characteristic parameter zc for a zero-crossing frequency has a neutral value that does not exceed the upper limit threshold value thUpZc and that is not smaller than the lower limit threshold value thLowZc, then the music characteristic score Smp remains zero with respect to the voice characteristic score Ssp.

In view of this, in the present embodiment, as shown in (b) of FIG. 7, a further another characteristic parameter lr is adopted. Generally, while in a voice signal a sound is localized near the center, in a music signal various musical sounds are localized at points other than the center, and thus, the difference in signal component between left and right channels is large.

Due to this property, when the characteristic parameter lr for an LR power ratio exceeds the upper limit threshold value thUpLR, a music characteristic score Smlr is added, and when the characteristic parameter lr for an LR power ratio is smaller than the lower limit threshold value thLowLR, a voice characteristic score Sslr is added. By this, as shown in (b) of FIG. 7, in a region S4 where after time t5 the characteristic parameter lr for an LR power ratio exceeds the upper limit threshold value thUpLR and thereafter the characteristic parameter lr exceeds the upper limit threshold value thUpZc over a predetermined period of time, the music characteristic score Smlr becomes greater than the voice characteristic score Ssp, whereby an instantaneous erroneous determination factor caused by the characteristic parameter pw for power fluctuations at time t4 is covered.

By thus providing a score to each of multiple characteristic parameters, even when a certain characteristic parameter has a value that causes a locally erroneous determination result, it is absorbed by another characteristic parameter and thus a correct determination result can be obtained.

Here, when performing a determination by scores such as that described above, by assigning weights to characteristic parameters according to the characteristics of the characteristic parameters, immunity against erroneous determination can be further strengthened. For example, if there are no other score contributions, when Smlr=Ssp, an erroneous determination factor is covered; however, if an instantaneous value of the characteristic parameter zc for a zero-crossing frequency exceeds the upper limit threshold value thUpZc and accordingly a voice characteristic score Ssz is added, Smlr<Ssp+Ssz is satisfied, causing erroneous determination.

Taking it into account, weights are assigned to scores. For example, in the case of the characteristic parameters pw and zc for power fluctuations and a zero-crossing frequency, there are many cases in which a determination between a voice signal and a music signal cannot be clearly made, and thus, it is difficult to relatively set upper and lower limit threshold values. Accordingly, low points are provided to scores Ssp, Ssz, Smp, and Smz that are obtained from the characteristic parameters pw and zc.

On the other hand, in the case of the characteristic parameter lr for an LR power ratio, a music signal has an extremely large left and right channel difference component as compared with a normal speech, etc., and thus a determination between a voice signal and a music signal can be clearly made. Accordingly, high points are provided to scores Sslr and Smlr that are obtained from the characteristic parameter lr. As such, for the way to assign weights to scores, an adjustment is made such that a characteristic parameter whose value clearly and easily differs between a voice signal and a music signal is allocated with a larger point.

Scores that are respectively generated by the voice/music characteristic score calculating modules 821 to 82*n* in the above-described manner are supplied to a synergetic-effect score calculating module 83 in the characteristic score control module 81. The synergetic-effect score calculating module 83 adds, after obtaining scores that are weighted in the above-described manner, scores that take into consideration interactions between characteristic parameters, to the weighted scores.

Specifically, the synergetic-effect score calculating module 83 extracts m sets of correlated characteristic parameters from n characteristic parameters. When characteristic parameters in each set all clear a threshold value for voice, the synergetic-effect score calculating module 83 further adds a point to voice characteristic scores Ss respectively supplied from the voice/music characteristic score calculating modules 821 to 82*n*. Also, when characteristic parameters in each set all clear a threshold value for music, the synergetic-effect score calculating module 83 further adds a point to music characteristic scores Sm respectively supplied from the voice/music characteristic score calculating modules 821 to 82*n*.

As an example, it is assumed that there are characteristic parameters param1 and param2 and as a result of performing a threshold value determination on each of the characteristic parameters param1 and param2, the voice characteristic scores Ss are provided with an $\alpha$ point based on the characteristic parameter param1 and provided with a $\beta$ point based on the characteristic parameter param2.

Here, if there is a correlation between the value of the characteristic parameter param1 and the value of the characteristic parameter param2 (for example, when the silence frame ratio is higher than or equal to a certain value and the power fluctuations are greater than or equal to a certain value, the same phenomenon that is silence between words in speech appears as different indices and thus these characteristic parameters can be said to be associated with each other), in addition to the score $\alpha$ and $\beta$ points by the respective characteristic parameters themselves, a score $\gamma$ that takes into consideration their synergetic effect is added. That is, a contribution to the voice characteristic scores Ss by the characteristic parameters param1 and param2 is $\alpha+\beta+\gamma$ points.

By thus performing the addition of a score, taking into consideration the correlation between characteristic parameters, voice/music determination accuracy by multiple parameters can be further improved. Specifically, in the present embodiment, first, for each characteristic parameter, weights are assigned independently to scores and thereafter a score that takes into consideration a synergetic effect of characteristic parameters is added. Thus, while determination conditions are allowed to have flexibility, a determination taking into consideration the correlation between characteristic parameters can be performed.

When extracting sets of characteristic parameters, i.e., selecting which combination of characteristic parameters has a correlation, a method such as that described above may be used in which characteristic parameters corresponding to the same phenomenon that is silence between words in speech are subjectively selected or a method may be used in which a correlation coefficient between characteristic parameters is calculated and a combination of characteristic parameters whose correlation coefficient is close to one is objectively selected.

A great advantage of the present embodiment associated with the above is that a characteristic parameter can be easily added and detection accuracy can be improved. In a scheme shown in the present embodiment, as described above, first, scores are independently set using individual characteristic parameters and thereafter a point that takes into consideration a synergetic effect is added to the scores, and thus, the addition of a characteristic parameter and the setting of each threshold value can be easily performed.

Figure 8:
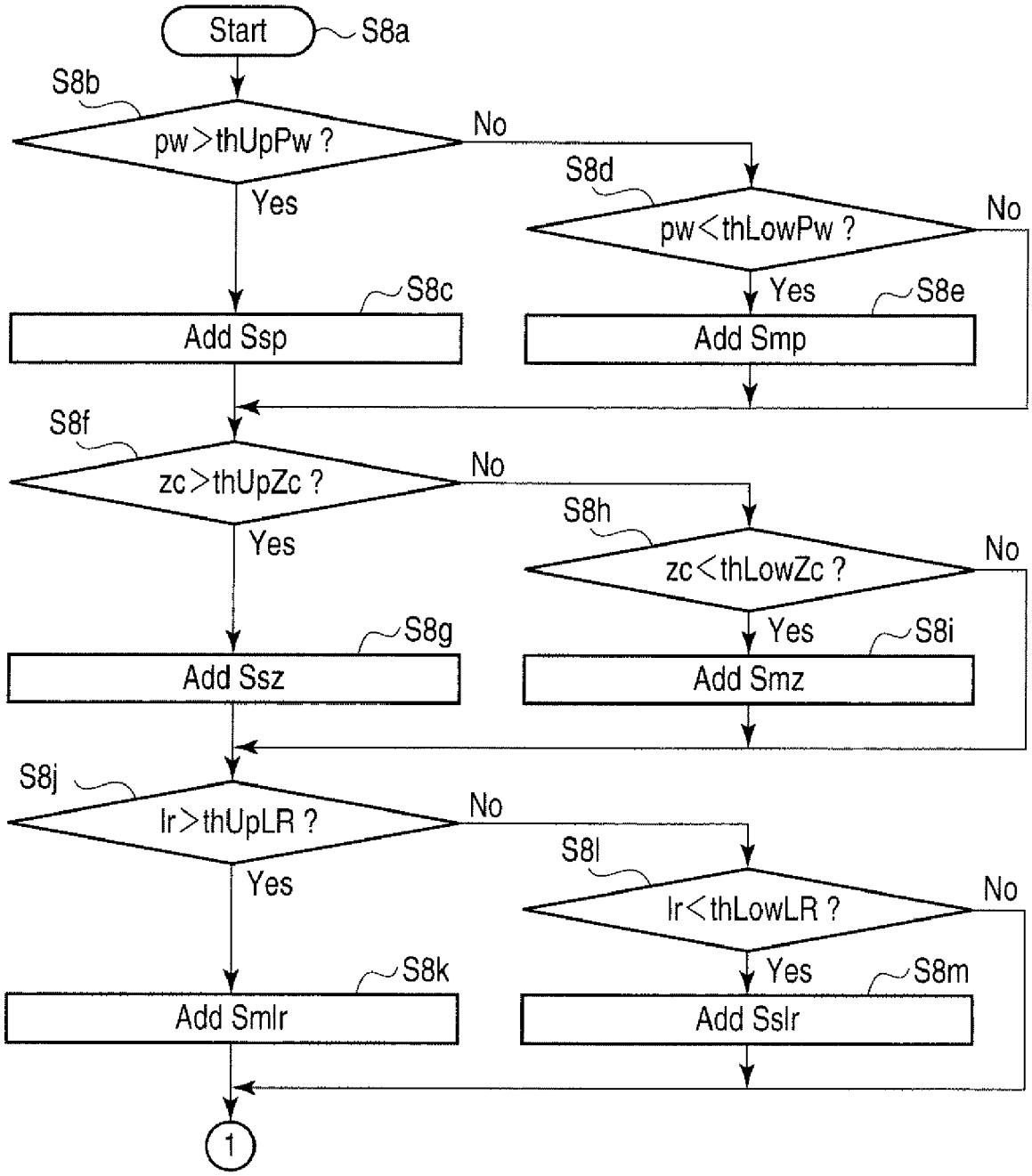
FIG. 8 is a flowchart for describing part of an operation performed by the characteristic score control module in the embodiment.
Figure 9:
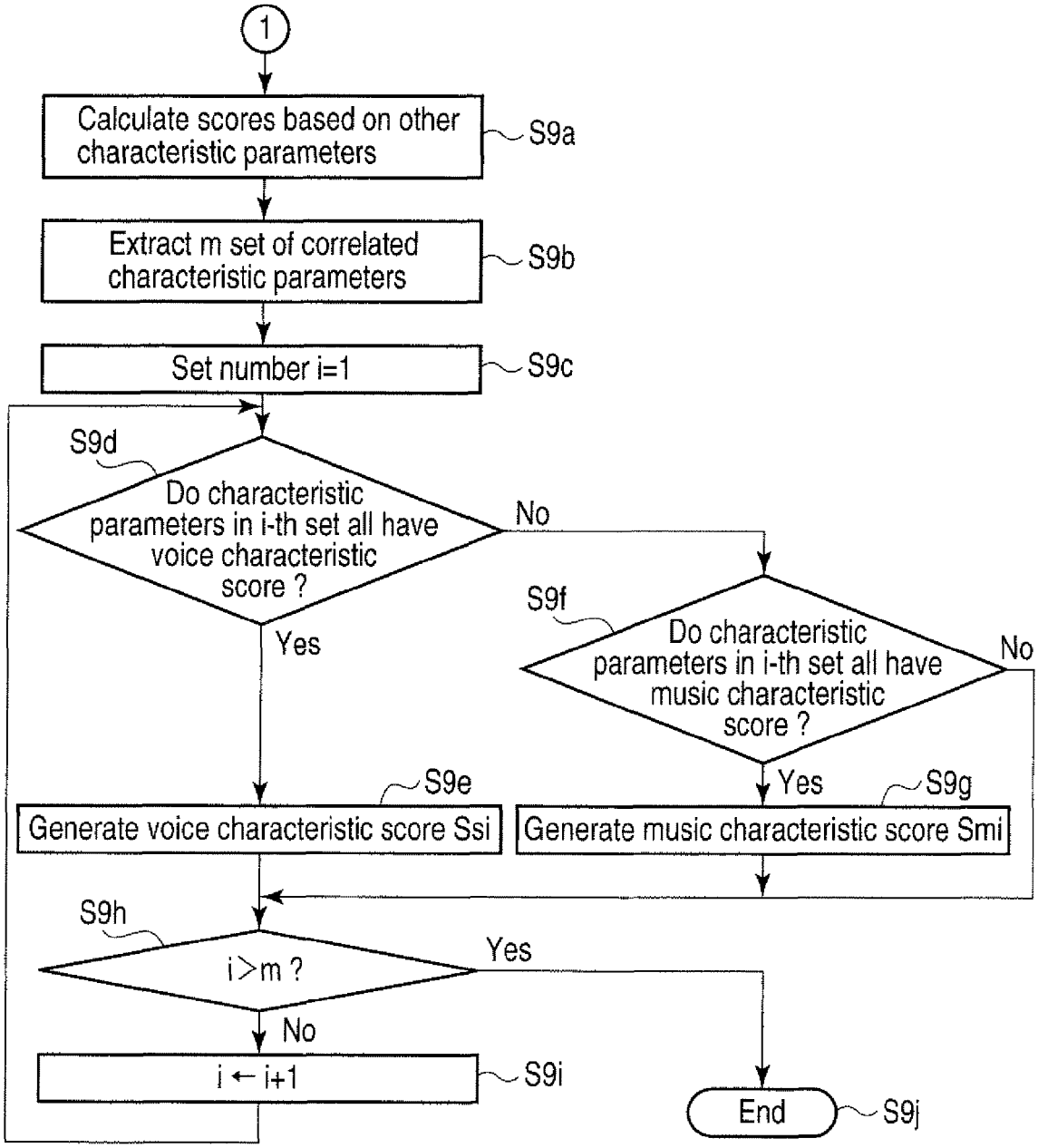
FIG. 9 is a flowchart for describing the remaining part of the operation performed by the characteristic score control module in the embodiment.

FIGS. 8 and 9 are flowcharts summarizing processing operations in which the above-described characteristic score control module 81 sets scores based on respective input characteristic parameters and adds a point that takes into consideration a correlation between the characteristic parameters, to the scores.

Specifically, when a process starts (step S8*a*), at step S8*b*, the characteristic score control module 81 determines, by the voice/music characteristic score calculating module 821, whether a characteristic parameter pw supplied from the parameter value calculating module 801 exceeds the upper limit threshold value thUpPw (pw>thUpPw). If it is determined that the characteristic parameter pw exceeds the upper limit threshold value thUpPw (YES), then at step S8*c* the voice/music characteristic score calculating module 821 adds a voice characteristic score Ssp.

If it is determined at the above-described step S8*b* that the characteristic parameter pw does not exceed the upper limit threshold value thUpPw (NO), then at step S8*d* the characteristic score control module 81 determines, by the voice/music characteristic score calculating module 821, whether the characteristic parameter pw supplied from the parameter value calculating module 801 is smaller than the lower limit threshold value thLowPw (pw<thLowPw). If it is determined that the characteristic parameter pw is smaller than the lower limit threshold value thLowPw (YES), then at step S8*e* the voice/music characteristic score calculating module 821 adds a music characteristic score Smp.

After the above-described step S8*c* or S8*e* or if it is determined at the above-described step S8*d* that the characteristic parameter pw is not smaller than the lower limit threshold value thLowPw (NO), then at step S8*f* the characteristic score control module 81 determines, by the voice/music characteristic score calculating module 822, whether a characteristic parameter zc supplied from the parameter value calculating module 802 exceeds the upper limit threshold value thUpZc (zc>thUpZc). If it is determined that the characteristic parameter zc exceeds the upper limit threshold value thUpZc (YES), then at step S8*g* the voice/music characteristic score calculating module 822 adds a voice characteristic score Ssz.

On the other hand, if it is determined at the above-described step S8*f* that the characteristic parameter zc does not exceed the upper limit threshold value thUpZc (NO), then at step S8*h* the characteristic score control module 81 determines, by the voice/music characteristic score calculating module 822, whether the characteristic parameter zc supplied from the parameter value calculating module 802 is smaller than the lower limit threshold value thLowZc (zc<thLowZc). If it is determined that the characteristic parameter zc is smaller than the lower limit threshold value thLowZc (YES), then at step S8*i* the voice/music characteristic score calculating module 822 adds a music characteristic score Smz.

After the above-described step S8*g* or S8*i* or if it is determined at the above-described step S8*h* that the characteristic parameter zc is not smaller than the lower limit threshold value thLowZc (NO), then at step S8*j* the characteristic score control module 81 determines, by the voice/music characteristic score calculating module 823, whether a characteristic parameter lr supplied from the parameter value calculating module 803 exceeds the upper limit threshold value thUpLR (lr>thUpLR). If it is determined that the characteristic parameter lr exceeds the upper limit threshold value thUpLR (YES), then at step S8*k* the voice/music characteristic score calculating module 823 adds a music characteristic score Smlr.

On the other hand, if it is determined at the above-described step S8*j* that the characteristic parameter lr does not exceed the upper limit threshold value thUpLR (NO), then at step S81 the characteristic score control module 81 determines, by the voice/music characteristic score calculating module 823, whether the characteristic parameter lr supplied from the parameter value calculating module 803 is smaller than the lower limit threshold value thLowLR (lr<thLowLR). If it is determined that the characteristic parameter lr is smaller than the lower limit threshold value thLowLR (YES), then at step S8*m* the voice/music characteristic score calculating module 823 adds a voice characteristic score Sslr.

After the above-described step S8*k* or S8*m* or if it is determined at the above-described step S81 that the characteristic parameter lr is not smaller than the lower limit threshold value thLowLR (NO), then at step S9*a* the characteristic score control module 81 performs, by other voice/music characteristic score calculating modules 824 to 82*n*, a comparison of characteristic parameters respectively supplied from the parameter value calculating modules 804 to 80*n* with their respective upper and lower limit threshold values, and provision of scores based on the comparison results.

Thereafter, the characteristic score control module 81 extracts, at step S9*b*, by the synergetic-effect score calculating module 83, m sets of correlated characteristic parameters and sets, at step S9*c*, by the synergetic-effect score calculating module 83, set number i=1. Then, at step S9*d*, the characteristic score control module 81 determines, by the synergetic-effect score calculating module 83, whether characteristic parameters in a set with set number i all clear a threshold value set for voice determination, i.e., whether a voice characteristic score is provided to all characteristic parameters in a set with set number i. If it is determined that a voice characteristic score is provided to all characteristic parameters (YES), then at step S9*e* the characteristic score control module 81 generates, by the synergetic-effect score calculating module 83, a voice characteristic score Ssi to be newly added.

On the other hand, if it is determined at the above-described step S9*d* that a voice characteristic score is not provided to all characteristic parameters in a set with set number i (NO), then at step S9*f* the characteristic score control module 81 determines, by the synergetic-effect score calculating module 83, whether characteristic parameters in a set with set number i all clear a threshold value set for music determination, i.e., whether a music characteristic score is provided to all characteristic parameters in a set with set number i. If it is determined that a music characteristic score is provided to all characteristic parameters (YES), then at step S9*g* the characteristic score control module 81 generates, by the synergetic-effect score calculating module 83, a music characteristic score Smi to be newly added.

After the above-described step S9*e* or S9*g* or if it is determined at the above-described step S9*f* that a music characteristic score is not provided to all characteristic parameters in a set with set number i (NO), then at step S9*h* the characteristic score control module 81 determines, by the synergetic-effect score calculating module 83, whether the set number i is greater than m that represents the number of sets. If it is determined that i>m is not satisfied (NO), then at step S9*i* the characteristic score control module 81 adds 1 to the set number i and then returns to the process at step S9*d*. On the other hand, if it is determined that i>m is satisfied (YES), then the characteristic score control module 81 ends the process (step S9*j*).

The scores that are respectively generated in the above-described manner by the voice/music characteristic score calculating modules 821 to 82*n* and the synergetic-effect score calculating module 83 in the characteristic score control module 81 are supplied to a voice/music determining module 84. The voice/music determining module 84 calculates total scores of respective input voice characteristic scores Ss and music characteristic scores Sm and determines, based on the calculated total scores, whether the signal is a voice signal or a music signal.

The determination may be performed by comparing the total score of the voice characteristic scores Ss with the total score of the music characteristic scores Sm and simply selecting a category with the higher total score. Alternatively, degrees at which the signal can be estimated as a voice signal and a music signal may be calculated from the total voice and music scores and information indicating the degrees may be output.

Furthermore, when comparing the total voice score with the total music score, a margin may be provided to a determination. For example, if the total music score deviates from the total voice score by a preset X point or more, then a category with the higher total score is adopted as a final result; on the other hand, if the deviation is less than the X point, then the score difference is not large enough and thus it is considered that the signal is in a state in which a clear distinction between music and voice is difficult to make.

In this case, a determination is intentionally suspended and a past signal classification result obtained when a score margin of the X point or more is last obtained is continuously adopted. By doing so, occurrence of erroneous detection can be suppressed in a section where a signal state is unclear with characteristic parameters to be used (where since the total music score and the total voice score are competitive, the higher and lower total scores are easily turned upside down by instantaneous fluctuations of a characteristic parameter).

Figure 10:
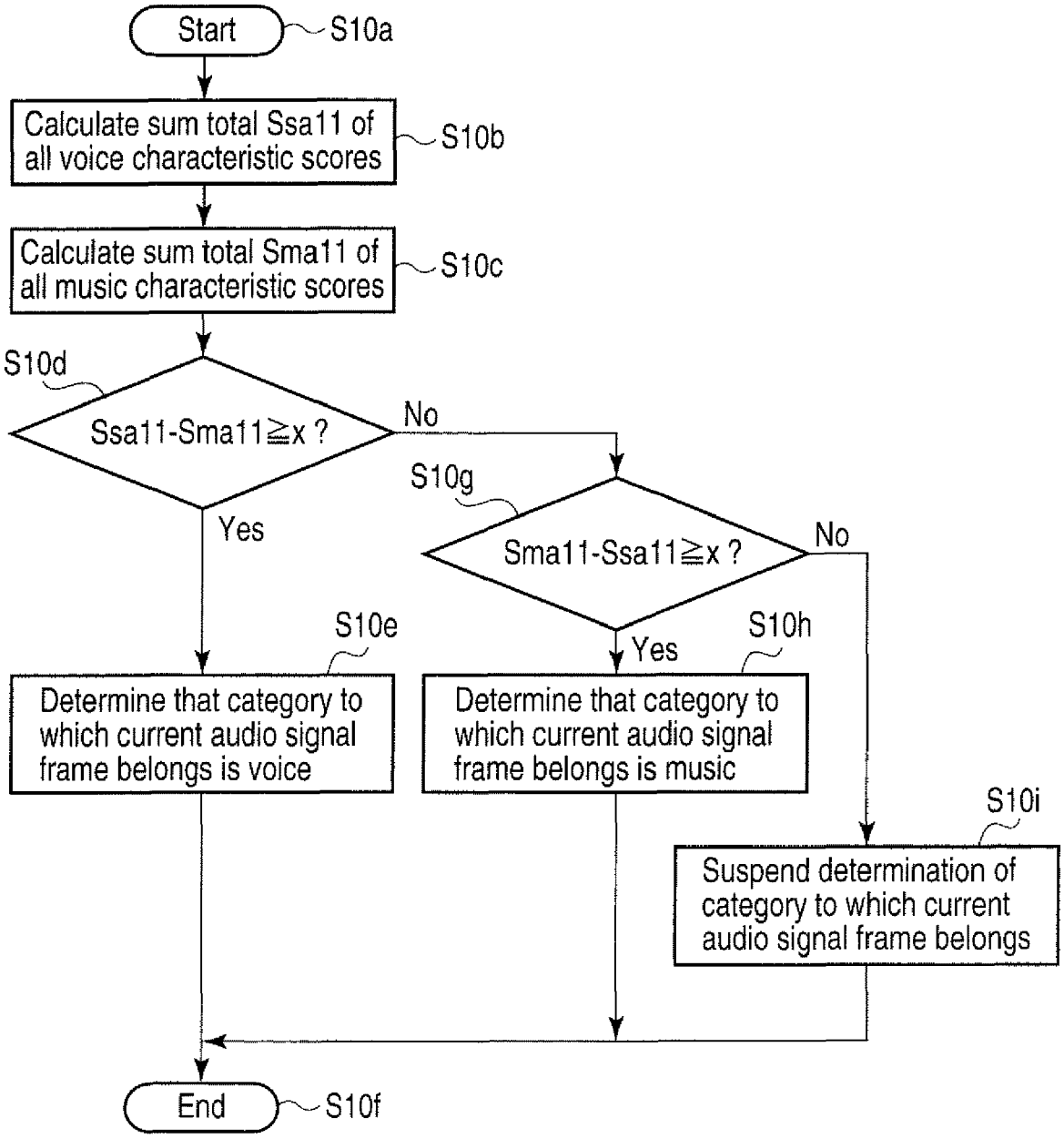
FIG. 10 is a flowchart for describing an operation performed by a voice/music determining module included in the sound quality correction processing module in the embodiment.

FIG. 10 is a flowchart summarizing processing operations in which the above-described voice/music determining module 84 calculates total scores of respective voice characteristic scores Ss and music characteristic scores Sm supplied from the characteristic score control module 81 and makes a determination between a voice signal and a music signal based on the total scores.

Specifically, when a process starts (step S10*a*), at step S10*b*, the voice/music determining module 84 calculates a sum total Ssall (=Ssp+Ssz+Sslr+ . . . +Ssi) of all voice characteristic scores provided by the characteristic score control module 81 to a voice signal category. Note that in the voice characteristic score Ssi i=1 to m.

At step S10*c*, the voice/music determining module 84 calculates a sum total Small (=Smp+Smz+Smlr+ . . . +Smi) of all music characteristic scores provided by the characteristic score control module 81 to a music signal category. Note that in the music characteristic score Smi i=1 to m.

Then, at step S10*d*, the voice/music determining module 84 determines whether a value obtained by subtracting the music characteristic score Small from the voice characteristic score Ssall is greater than or equal to the preset point X (Ssall-Small≧X). If it is determined that Ssall-Small≧X is satisfied (YES), then at step S10*e* the voice/music determining module 84 determines that the category to which a current audio signal frame belongs is voice and ends the process (step S10*f*).

On the other hand, if it is determined at the above-described step S10*d* that Ssall-Small≧X is not satisfied (NO), then at step S10*g* the voice/music determining module 84 determines whether a value obtained by subtracting the voice characteristic score Ssall from the music characteristic score Small is greater than or equal to the preset point X (Small-Ssall≧X). If it is determined that Small-Ssall≧X is satisfied (YES), then at step S10*h* the voice/music determining module 84 determines that the category to which a current audio signal frame belongs is music and ends the process (step S10*f*).

Furthermore, if it is determined at the above-described step S10*g* that Small-Ssall≧X is not satisfied (NO), then at step S10*i*, the voice/music determining module 84 suspends a determination of a category to which a current audio signal frame belongs, and continuously adopts a determination result obtained when Ssall-Small≧X or Small-Ssall≧X is last obtained, and then ends the process (step S10*f*).

A result of the determination made in the above-described manner by the voice/music determining module 84 is supplied to the audio correction processing module 78. The audio correction processing module 78 performs a sound quality correction process based on the determination result obtained by the voice/music determining module 84, on an audio signal supplied to the input terminal 77 and outputs the processed audio signal to an external source from an output terminal 85.

Specifically, the audio correction processing module 78 functions as follows. When the determination result obtained by the voice/music determining module 84 is voice, the audio correction processing module 78 performs a sound quality correction process on the input audio signal to achieve clarity by emphasizing a center-localized component. When the determination result obtained by the voice/music determining module 84 is music, the audio correction processing module 78 performs a sound quality correction process on the input audio signal to obtain expanded, emphasized stereo sound.

The various modules of the systems described herein can be implemented as software applications, hardware and/or software modules, or components on one or more computers, such as servers. While the various modules are illustrated separately, they may share some or all of the same underlying logic or code.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A voice/music determining apparatus comprising:

a characteristic parameter calculator configured to calculate a plurality of characteristic parameters for determining whether an input audio signal is a voice signal or a music signal;

a voice/music characteristic score calculator configured to compare each of the plurality of characteristic parameters calculated by the characteristic parameter calculator with a threshold value for voice determination and a threshold value for music determination, and provide a voice characteristic score to each of the plurality of characteristic parameters having been determined to be voice and provide a music characteristic score to each of the plurality of characteristic parameters having been determined to be music; and a voice/music determining module configured to calculate a difference between a sum total of the voice characteristic scores calculated by the voice/music characteristic score calculating module and a sum total of the music characteristic scores calculated by the voice/music characteristic score calculating module, to determine that the input audio signal is a voice signal when the sum total of the voice characteristic scores is greater than the sum total of the music characteristic scores in a state in which the calculated difference is not less than a preset value, and to determine that the input audio signal is a music signal when the sum total of the music characteristic scores is greater than the sum total of the voice characteristic scores in the state in which the calculated difference is not less than a preset value.

2. A voice/music determining apparatus of claim 1, wherein the characteristic parameter calculator is configured to generate the characteristic parameters by:

dividing the input audio signal into predetermined frame units, each including a plurality of subframes;

calculating, in a subframe unit, determination information for determining whether the input audio signal is a voice signal or a music signal; and obtaining, in a frame unit, statistics of the determination information.

3. A voice/music determining apparatus of claim 1, wherein the characteristic parameter calculator is configured to calculate the plurality of characteristic parameters for the input audio signal, the plurality of characteristic parameters including at least one of power fluctuations, a zero-crossing frequency, and a power ratio between stereo left and right signals.

4. A voice/music determining apparatus of claim 1, wherein the voice/music characteristic score calculator is configured to:

provide the characteristic parameter having been determined to be voice, with a voice characteristic score to which a weight according to a characteristic of the characteristic parameter is assigned; and provide the characteristic parameter having been determined to be music, with a music characteristic score to which a weight according to a characteristic of the characteristic parameter is assigned.

5. A voice/music determining apparatus of claim 1, wherein the voice/music characteristic score calculator is configured to:

extract a set of correlated characteristic parameters from the plurality of characteristic parameters calculated by the characteristic parameter calculator, and further provide a voice characteristic score when the characteristic parameters included in the set are all determined to be voice; and extract a set of correlated characteristic parameters from the plurality of characteristic parameters calculated by the characteristic parameter calculator, and further provide a music characteristic score when the characteristic parameters included in the set are all determined to be music.

6. A voice/music determining apparatus of claim 1, wherein the voice/music determining module is configured to continuously adopt, when the difference between the sum total of the voice characteristic scores calculated by the voice/music characteristic score calculator and a sum total of the music characteristic scores calculated by the voice/music characteristic score calculator equals or exceeds a preset predetermined point, a determination result obtained when the difference last becomes the predetermined point or more.

7. A voice/music determination method comprising:

supplying an input audio signal to a characteristic parameter calculator to calculate a plurality of characteristic parameters for determining whether the input audio signal is a voice signal or a music signal;

supplying the calculated plurality of characteristic parameters to a voice/music characteristic score calculator to compare each of the plurality of characteristic parameters with a threshold value for voice determination and a threshold value for music determination, and providing a voice characteristic score to each of the plurality of characteristic parameters having been determined to be voice and providing a music characteristic score to each of the plurality of characteristic parameters having been determined to be music; and supplying the voice characteristic scores and the music characteristic scores to a voice/music determining module to calculate a difference between a sum total of the voice characteristic scores calculated by the voice/music characteristic score calculating module and a sum total of the music characteristic scores calculated by the voice/music characteristic score calculating module, to determine that the input audio signal is a voice signal when the sum total of the voice characteristic scores is greater than the sum total of the music characteristic scores in a state in which the calculated difference is not less than a preset value, and to determine that the input audio signal is a music signal when the sum total of the music characteristic scores is greater than the sum total of the voice characteristic scores in the state in which the calculated difference is not less than a preset value.

8. A computer-readable medium of a storage device, the computer-readable medium having tangibly stored thereon a voice/music determination program, which when executed by a computer, causes the computer to perform operations comprising:

calculating a plurality of characteristic parameters for determining whether an input audio signal is a voice signal or a music signal;

comparing each of the plurality of characteristic parameters with a threshold value for voice determination and a threshold value for music determination, and providing a voice characteristic score to each of the plurality of characteristic parameters having been determined to be voice and providing a music characteristic score to each of the plurality of characteristic parameters having been determined to be music; and calculating a difference between a sum total of the voice characteristic scores and a sum total of the music characteristic scores, to determine that the input audio signal is a voice signal when the sum total of the voice characteristic scores is greater than the sum total of the music characteristic scores in a state in which the calculated difference is not less than a preset value, and to determine that the input audio signal is a music signal when the sum total of the music characteristic scores is greater than the sum total of the voice characteristic scores in the state in which the calculated difference is not less than a preset value.

* * * * *